United States Patent [19]

Vanassche et al.

[11] 4,287,296

[45] Sep. 1, 1981

[54] DIRECT-POSITIVE EMULSION CONTAINING FOGGED, SILVER HALIDE GRAINS OF SILVER IODIDE CONTENT

[75] Inventors: Willy J. Vanassche, Kontich; Herman A. Pattyn, Kapellen, both of Belgium; Erik Moisar, Köln-Flittard; Sieghart Klötzer, Cologne, both of Fed. Rep. of Germany

[73] Assignee: Agfa-Gevaert, N.V., Mortsel, Belgium

[21] Appl. No.: 417,497

[22] Filed: Nov. 20, 1973

[30] Foreign Application Priority Data

Dec. 23, 1972 [DE] Fed. Rep. of Germany ..... 2263246

[51] Int. Cl.[3] ..... G03C 5/24; G03C 1/36

[52] U.S. Cl. ..... 430/411; 430/567; 430/596; 430/412; 430/597; 430/444; 430/599; 430/604; 430/605; 430/570

[58] Field of Search ..... 96/64, 107, 108, 101, 96/120, 66.1; 430/567, 411, 596, 412, 597, 444, 599, 604, 605, 570

[56] References Cited

U.S. PATENT DOCUMENTS

| | | | |
|---|---|---|---|
| 2,500,140 | 3/1950 | Teal et al. | 96/107 |
| 3,320,069 | 5/1967 | Illingsworth | 96/107 |
| 3,367,778 | 2/1968 | Berriman | 96/107 |
| 3,501,305 | 3/1970 | Illingsworth | 96/101 |
| 3,531,290 | 9/1970 | Litzerman | 96/107 |
| 3,647,455 | 3/1972 | Burt et al. | 96/64 |
| 3,740,226 | 6/1973 | Dappen | 96/64 |
| 3,759,713 | 9/1973 | Florens | 96/108 |
| 3,870,522 | 3/1975 | Moisar et al. | 96/107 |

*Primary Examiner*—Won H. Louie, Jr.
*Attorney, Agent, or Firm*—A. W. Breiner

[57] ABSTRACT

Direct positive silver halide emulsions are provided which contain fogged silver halide grains the said grains being heterodisperse and containing silver iodide in an amount of more than 10 mole % and at most 20 mole % relative to the total amount of silver halide. The emulsions have increased sensitivity and reduced gradation which is suitable for continuous tone reproduction.

14 Claims, No Drawings

DIRECT-POSITIVE EMULSION CONTAINING FOGGED, SILVER HALIDE GRAINS OF SILVER IODIDE CONTENT

This invention relates to a photographic material and to a process for producing direct positive photographic images by imagewise exposure of the photographic material which contains at least one fogged silver halide emulsion layer, the developable fog being eliminated and a direct positive image being obtained subsequently by photographic development.

Direct positive images are generally produced by exposing or chemically treating fogged silver halide emulsions. If certain conditions are observed, the developable fog is destroyed in the light struck areas but remains intact in the unexposed areas. Development of the emulsion after exposure results in a direct positive image. Destruction of the developable fog by imagewise exposure is achieved mainly by utilizing the Herschel effect or the solarisation effect. In the former case, exposure is carried out with long wave light from the absorption range of silver so that the silver nuclei are destroyed in the light struck areas. In the case of the solarisation effect, on the other hand, exposure is carried out with shortwave light from the absorption range of the silver halide. This also leads to destruction of the developable fog. These processes have remained of minor importance in practice because the usual photographic emulsions have but a relatively low sensitivity.

An improvement in the sensitivity to light can be achieved by optimising the fogging methods and by adding desensitizers, which act as electron traps. Emulsions of this kind have been described in U.K. Patent Specification No. 723,019. These emulsions are fogged by means of reducing agents in the presence of compounds of noble metals that are more electropositive than silver. According to U.S. Pat. No. 3,501,305, an even greater increase in the sensitivity of direct positive emulsions is achieved by using monodisperse silver halide emulsions, which are fogged on the surface by means of reducing agents and gold compounds. These monodisperse silver halide emulsions are characterised by a narrow grain size distribution, at least about 95% by weight of the silver halide in the emulsion being made up of grains, which do not differ from the average grain size by more than 40%. Emulsions of this kind are prepared by the so-called double inflow process, i.e. the simultaneous inflow of silver salts and alkali metal halides during precipitation.

Processes of this kind have been described in German Patent Specification No. 1,169,290.

Monodisperse cubic or octahedral emulsions have serious disadvantages, which lie in the nature of the method used for their preparation, since the double inflow process and the maintenance of definite pAg values require a considerable expenditure in apparatus. Another disadvantage lies in the photographic properties of such monodisperse direct positive fogged silver halide emulsions in that these emulsions give rise to images with a relatively steep gradation. The practical application of these emulsions is therefore restricted to those cases in which a steep gradation is either desired or is at least acceptable.

For the production of continuous-tone images, these emulsions are only of minor importance on account of the steep gradation. It has been proposed to flatten the gradation by mixing several monodisperse direct positive silver halide emulsions that have been fogged to different levels. Stepped positive gradation curves are then obtained. By mixing a sufficiently large number of such monodisperse emulsions, the steps in the gradation curve can be kept small and direct positive emulsions with flatter gradation curves are in fact obtained, but even this method is of limited interest in practice because the preparation of a plurality of monodisperse direct positive emulsions which are fogged to different levels is relatively complicated and not sufficiently reproducible.

It is an object of this invention to prepare direct positive silver halide emulsions with a very high sensitivity to light by a technologically simple process, the emulsions obtained by this process being suitable for producing direct positive images with a flat gradation as required for continuous tone images.

In accordance with the present invention, a photographic material is provided which contains at least one layer of a direct-positive radiation-sensitive emulsion containing fogged silver halide grains wherein the said grains are heterodisperse and irregular and have a grain-size distribution so that at least 10% and preferably at least 20% by weight of the grains have a diameter, which deviates for at least 40% from the mean grain diameter, and wherein the silver iodide content of the silver halide grains is more than 10 mole % and at most about 20 mole % relative to the total amount of the silver halide in the fogged emulsion layer. The silver iodide content is preferably comprised between about 12 and about 20 mole %.

The fogged direct positive emulsions to be used in accordance with the invention have a substantially higher sensitivity and in most cases also a higher maximum density than those emulsions, which are free from iodide or have only a low silver iodide content. This finding is all the more surprising since it is known that in conventional negative silver halide emulsions that have not been fogged, although the addition of silver iodide in small quantities of only a few percent may increase the sensitivity, higher silver iodide contents of more than 10% have the effect of considerably reducing the sensitivity.

The direct positive silver halide emulsions used for the photographic material according to the invention are prepared by known methods. The simplest method consists in adding an aqueous silver salt solution, preferably a silver nitrate solution, to a gelatin-containing solution of the other precipitation component. The precipitation components used are preferably aqueous solutions of alkali metal halides. The desired average grain size and grain size distribution can be modified in known manner by adding an excess of halide and by suitably adjusting the conditions, under which physical ripening takes place, in particular the temperature and time.

In accordance with the present invention the direct positive silver halide emulsions of high iodide content are free from interior ripening nuclei, e.g. emulsions having adsorbed to the surface of the silver halide grains electron-accepting or desensitizing compounds e.g. as described in U.K. Patent Specification No. 723,019.

Other direct positive emulsions, which are suitable for this invention have been described in the German Patent Specifications 606,392 and 642,222 and in the U.K Patent Specifications 581,773 and 655,009. The emulsions may also contain mercury salts or thallium salts as described in the published German Patent Application 1,622,256.

Fogging of the silver halide grains can occur in any suitable known manner, which consists of providing the silver halide grains with silver nuclei and/or nuclei of a metal more electropositive than silver including gold, platinum, palladium, iridium, etc.

The silver halide grains may be provided with silver nuclei e.g. by an overall uniform exposure to actinic radiation and preferably by reduction sensitization e.g. by high pH and/or low pAg silver halide precipitation or digestion conditions e.g. as described by Wood, J. Phot.Sci. 1 (1953) 163, or by treatment with reducing agents e.g. tin(II)salts e.g. tin(II)chloride, tin complexes and tin chelates of the (poly)amino(poly)carboxylic acid type as described in the U.K. Pat. No. 1,209,050 filed Dec. 27, 1967 by Agfa-Gevaert N. V., formaldehyde, hydrazine, hydroxylamine, sulphur compounds such as thiourea dioxide, phosphonium salts such as tetra(hydroxymethyl)-phosphonium chloride, polyamines such as diethylenetriamine, bis(p-aminoethyl)-sulphide and its water-soluble salts, etc.; preferred reducing agents are thiourea dioxide and tin(II)chloride.

The silver halide grains can also be provided with nuclei of a metal more electropositive than silver, for example, by treatment of the silver halide grains (which may have been provided with silver nuclei) with a compound of a metal more electropositive than silver, preferably in the form of water-soluble salts e.g. potassium chloroaurate, gold(III) chloride, ammonium hexachloropalladate, potassium chloroiridate and the like. The treatment with a gold compound may occur by means of a mixture of a water-soluble noble metal compound e.g. gold(III)chloride and thiocyanates forming complexes with gold and having a solvent action on the silver halide grains, e.g. alkali metal and ammonium thiocyanates.

In the formation of direct-positive silver halide emulsions, fogging of the silver halide grains is very suitably effected by reduction sensitization e.g. by high pH and/or low pAg digestion conditions or by means of a reducing agent e.g. thiourea dioxide together with a compound of a metal more electropositive than silver, especially a gold compound. The reducing agent is preferably used initially and the gold compound subsequently. However, the reverse order can be used or both compounds can be used simultaneously.

The degree of fogging of the direct positive silver halide emulsions may vary within a very wide range. It is generally sufficient to use about 0.0005 to about 0.06 milliequivalents of reducing agents and about 0.001 to about 0.01 millimoles of the noble metal salt per mole of silver halide as described in the published German Patent Application 1,547,790. If the emulsions have been fogged too heavily, they may subsequently be treated with a bleaching agent in known manner to adjust the light sensitivity of the direct positive emulsions to the optimum level.

As is known in the art, the degree of fogging not only depends on the concentration of the fogging agents used but also on the pH, the pAg, the temperature, and the duration of the fogging treatment. High photographic speeds are obtained at low degrees of fogging as is illustrated in the U.S. Pat. No. 3,501,307 of Bernard D. Illingsworth issued Mar. 17, 1970 and the U.K. Patent Application No. 7742/72 filed Feb. 18, 1972 by Agfa-Gevaert N. V.

In the U.S. Pat. No. 3,501,307 as mentioned above direct-positive silver halide emulsions comprising fogged silver halide grains and a compound accepting electrons, are described wherein the grains are fogged to such an extent that a test portion of the emulsion when coated on a support to give a maximum density of at least about 1, upon processing for 6 minutes at about 20° C. in a developer of the composition given hereinafter shows a maximum density at least about 30% higher than the maximum density of an identical test portion processed for 6 minutes at about 20° C. in such developer after bleaching for about 10 minutes at about 20° C. in a bleaching bath having the composition given hereinafter.

| Bleaching bath | | |
|---|---|---|
| potassium cyanide | 50 | mg |
| glacial acetic acid | 3.47 | ml |
| sodium acetate | 11.49 | g |
| potassium bromide | 119 | mg |
| water to make | 1 | liter |

| Developer | | |
|---|---|---|
| N-methyl-p-aminophenol sulphate | 2.5 | g |
| sodium sulphite | 30.0 | g |
| hydroquinone | 2.5 | g |
| sodium metaborate | 10.0 | g |
| potassium bromide | 0.5 | g |
| water to make | 1 | liter |

According to the copending U.K. Patent Application No. 7742/72 as mentioned above the silver halide grains are fogged to such an extent that a test portion of the emulsion, when coated on a support at a ratio of 0.50 g to 5.50 g of silver per sq.m gives a density of less than 0.50 upon processing without exposure for 6 min. at 20° C. in the above developer and an identical test portion thereof when coated in an identical way gives a density of at least twice the value of the density of the first test portion and a density of at least 0.50 upon processing without exposure for 3 minutes at 20° C. in a developer of the following composition:

| | | |
|---|---|---|
| hydroquinone | 15 | g |
| 1-phenyl-3-pyrazolidinone | 1 | g |
| trisodium salt of ethylenediamine-tetraacetic acid | 1 | g |
| anhydrous sodium carbonate | 30 | g |
| anhydrous sodium sulphite | 70 | g |
| 40% aqueous sodium hydroxide | 16 | ml |
| water to make | 1 | liter |
| | (pH : 11) | |

As a consequence, the terms "fogged" and "fogging" as used herein are employed in a very broad sense so that the very low degrees of fogging as defined in the above copending British Patent Application are also embraced. This means that, in accordance with the present invention, fogging is effected to such extent that a test portion of the emulsion when coated on a support at a coverage of 0.50 to 5.50 g of silver sq.m., gives a density of at least 0.50 upon processing for 3 minutes at 20° C. in the above latter developer composition.

As already indicated above, the sensitivity to light of fogged direct positive emulsions that are free from internal nuclei can be improved by the addition of desensitizers that are absorbed on the surface of the grain and act as electron traps.

According to Sheppart et al J. Phys.Chem.50 (1946) 210, Stanienda, Z.Phys.Chem. (NF) 32 (1962) 238, and Dähne, Wiss. Phot. (1969) 161, desensitizers are dyestuffs whose cathodic polarographic half-wave potential, measured against the calomel electrode, is more positive than −1.0 1 V. Such compounds have also been described in the U.S. Pat. Nos 3,501,305, 3,501,306 and 3,501,307 all of Bernard D. Illingsworth issued Mar. 17, 1970. The sensitizers described in the German Patent Specification 1,153,246 filed Apr. 11, 1962 by Agfa A.G. and U.S. Pat. No. 3,314,796 of Sohannes Götze, August Randolph and Oskar Riester issued Apr. 18, 1967 are also suitable for this purpose as well as imidazo-quinoxaline dyestuffs, e.g. those described in the Belgian Patent Specification 660,253 filed Feb. 25, 1965 by Kodak Co.

It is known to characterize these electron-accepting or desensitizing compounds by means of their polarographic half-wave potential. Electron acceptors suitable for use in the direct-positive silver halide emulsions of the present invention have an anodic polarographic half-wave potential and a cathodic polarographic half-wave potential that when added together give a positive sum. Methods of determining these polarographic half-wave potentials have been described, e.g., in the U.S. Pat. Nos. 3,501,310 of Bernard D. Illingsworth issued Mar. 17, 1970 and 3,531,290 of Roberta A. Litzerman issued Sept. 29, 1970.

The electron-accepting compounds preferably have spectrally sensitizing properties although it is possible to use electron-accepting compounds that do not spectrally sensitize the emulsion.

The direct positive photographic silver halide materials of the present invention have excellent sensitivity. Direct positive images can be obtained with markedly reduced gradation as compared with known monodisperse direct positive emulsion of comparable sensitivity, same average grain-size and coated at the same ratio of silver halide per sq.m.

In the preparation of the direct-positive photographic silver halide emulsion for use in accordance with the present invention gelatin is preferably used as vehicle for the silver halide grains. However, the gelatin may be wholly or partly replaced by other natural hydrophilic colloids, e.g. albumin, zein, agar-agar, arabic, alginic acid and derivatives thereof e.g. salts, amides and esters, starch and derivatives thereof, cellulose derivatives e.g. cellulose ethers, partially hydrolysed cellulose acetate carboxymethyl cellulose etc. or synthetic hydrophilic resins, for example polyvinyl alcohol, polyvinyl pyrrolidone, homo- and copolymers of acrylic and methacrylic acid or derviatives e.g. esters, amides and nitriles, vinyl polymers e.g. vinyl ethers and vinyl esters.

The direct-positive silver halide emulsions for use in accordance with the present invention may comprise all kinds of emulsion ingredients suitable for direct-positive emulsions. They may comprise e.g. speed-increasing compounds such as polyalkylene glycols, cationic surface-active agents of the ammonium, sulphonium and phosphonium type, thioethers, etc. They may further comprise known antifoggants and stabilizers, which include thiazolium salts, azaindenes, e.g. hydroxytetraazaindenes such as 5-methyl-7-hydroxy-s-triazolo[1,5-a]pyrimidine, mercury compounds e.g. mercury oxide, mercury chloride, mercury cyanide, nitroindazoles, nitrobenzimidazoles, mercaptotetrazoles such as 1-phenyl-5-mercaptotetrazole, etc. They may comprise as compounds increasing the reversal speed of direct-positive silver halide emulsions selenium compounds of the kind described in the Belgian Pat. No. 763,827 filed Mar. 5, 1971 by Gevaret-Agfa N. V., quinone compounds of the kind described in the U.S. Defensive Publication No. T883,031 of Paul B. Gilman Jr., and Frederik J. Rauner issued Feb. 23, 1971, polymeric as well as non-polymeric 1,2- and 1,4-dihydroxybenzene compounds e.g. 2-chlorohydroquinone, tetrachlorohydroquinone, pyrocatechol, the polymeric reaction product of quinone with ammonia prepared as described in Wysokomolekularnye Soedinenya, 1968, Part A (X), Nr.8, p. 1890 by Berlin et al in which the hydroquinone or quinone recurring units are interlinked by —NH— units, and other related polymeric compounds having interlinking —S— and —O— units, as well as polymeric compounds comprising hydroquinone substituents, e.g. those described in the U.S. Pat. Nos. 3,165,495 of Lloyd D. Taylor issued Jan. 21, 1965 and 3,186,970 of Norman W. Schuler issued June 1, 1965.

Spectrally sensitizing dyes that are not electron-accepting such as e.g. cyanines, merocyanines, complex (trinuclear) cyanines, complex (trinuclear) merocyanines, styryls, and hemicyanines may also be present in the emulsion. The direct positive emulsions may also contain compounds increasing the blue sensitivity, e.g. according to the U.K. Pat. No. 1,186,718. Compounds of this type have an anodic polarographic potential of less than 0.85 and a cathodic polarographic potential with a value that is more negative than −1.0. Suitable sensitizers have also been described e.g. in the U.S. Pat. No. 3,531,290.

Further, colour couplers may be incorporated into the direct-positive emulsions employed in the present invention. Particularly suitable are colour couplers showing a low halogen-accepting character, which can be determined by the test described by R.P. Held in Phot.Sci.Eng.Vol. 11, (1967) p.406. For this purpose a dispersion of silver bromide grains in buffered 0.1 N potassium bromide is illuminated and the potential is registered by means of a calomel/platinum electrode system. During illumination the platinum electrode potential rises rapidly to the redox potential of bromine. On addition of a colour coupler the potential rise can be delayed through "halogen acceptance" by the colour coupler. Colour couplers as well as other emulsion ingredients including binding agents for the silver halide that do not delay or do not substantially delay the potential rise are particularly suitable for use in direct-positive silver halide emulsions.

The colour couplers can be incorporated into the direct positive photographic silver halide emulsion using any suitable technique known to those skilled in the art for incorporating colour couplers in silver halide emulsions. For example, water-soluble colour couplers e.g. those containing one or more sulpho or carboxyl groups (in acid or salt form) can be incorporated from an aqueous solution, if necessary, in the presence of alkali and the water-insoluble or insufficiently water-soluble colour couplers from a solution in the appropriate water-miscible or water-immiscible high-boiling (oil-former) or low-boiling organic solvents or mixtures of solvents, which solution is dispersed, if necessary in the presence of a surface-active agent, in a hydrophilic colloid composition forming or forming part of the binding agent of the silver halide emulsion; if necessary, the low-boiling solvent can be removed afterwards by evaporation.

The silver halide emulsion layer and other hydrophilic colloid layers of a direct-positive photographic material employed in accordance with the present invention may be hardened by means of organic or inorganic hardeners commonly employed in photographic silver halide elements, e.g. the aldehydes and blocked aldehydes such as formaldehyde, dialdehydes, hydroxyaldehydes, mucochloric and mucobromic acid, acrolein, glyoxal, sulphonyl halides and vinyl sulphones, etc.

The direct positive photographic silver halide elements may further contain antistatic agents, wetting agents as coating aids, e.g. saponin and synthetic surface-active compounds, plasticizers, matting agents, e.g. starch, silica, polymethyl methacrylate, zinc oxide, titanium dioxide, etc., optical brightening agents including stilbene, triazine, oxazole and coumarin brightening agents, light-absorbing materials and filter dyes, mordanting agents for anionic compounds, etc.

The sensitivity and stability of the direct positive silver halide emulsions can also be improved by reducing their pH before casting, preferably to about 5, and/or increasing the pAg of the emulsion, preferably to a value which corresponds to an EMF of +30 mV or less (silver against saturated calomel electrode) in accordance with the U.K Patent Application 32,889/72.

The direct-positive silver halide emulsions can be coated on one or both sides of a wide variety of supports, which include opaque supports e.g. paper and metal supports as well as transparent supports e.g. glass, cellulose nitrate film, cellulose ester film, polyvinyl acetal film, polystyrene film, polyethylene terephthalate film, polycarbonate film and other films of resinous materials. It is also possible to use paper coated with α-olefin polymers e.g. paper coated with polyethylene, polypropylene, ethylene-butene copolymers etc.

Development of the exposed direct-positive silver halide emulsions of the invention may occur in alkaline solutions containing conventional developing agents such as hydroquinones, catechols, aminophenols, 3-pyrazolidinones, phenylenediamines, ascorbic acid and derivatives, hydroxylamines, etc. or combinations of developing agents. The exposed direct-positive emulsions may be developed to produce direct-positive black-and-white images or they may be developed to produce direct-positive colour images by means of aromatic primary amino colour developing agents, more particularly the known p-phenylenediamine developing agents, in the presence of colour couplers, which are incorporated in the emulsion or in the developing composition.

Development may occur by means of a combination of developing agents that have a superadditive action, e.g. hydroquinone together with N-methyl-p-aminophenol sulphate or other p-aminophenol derivatives and hydroquinone or a p-phenylenediamine colour developing agent together with 1-phenyl-3-pyrazolidinone or other 3-pyrazolidinone derivatives. It may be advantageous to effect development of the exposed direct positive silver halide emulsions with compositions substantially free from halide ions. Development with developing compositions substantially free from halide ions is particularly favourable in order to obtain high maximum densities for direct-positive silver halide emulsions, the silver halide grains of which have been fogged to a very low degree.

One or more developing agents may be incorporated in the direct positive photographic element. They may be incorporated into the silver halide emulsion itself and/or elsewhere in the photographic element. Development can then be effected by means of an alkaline processing solution called development activator solution, which is substantially free of developing agents.

During the processing of the photographic materials of the invention, the high silver iodide content give rise to staining of the processing solutions. Therefore, the processing solution used to effect development of the exposed direct-positive silver halide emulsion and which comprises or does not comprise one or more developing agents is preferably supplied in an amount that suffices for the treatment of exactly one piece of light-sensitive element. Therefore, it is preferred to employ a single-use bath. A bath of this type offers the advantage that ageing and contamination of the bath composition are eliminated. For one-time use the processing solution is preferably relatively viscous so as to be easily controlled when spread. Viscous processing solutions can be obtained by addition of a thickening agent, e.g. a water-soluble polymer. The film-forming plastic may be any of the high molecular weight polymers that are stable to alkali and that are soluble in aqueous alkaline solutions e.g. hydroxyethylcellulose, starch or gum, polyvinyl alcohol, the sodium salts of polymethacrylic acid and polyacrylic acid, sodium alginate, sodium carboxymethyl cellulose etc. The relatively viscous processing composition may be confined within a container, which is ruptured at the moment of development as is done, for example, in the well-known silver complex diffusion transfer process for in-camera processing.

Photographic materials, which contain at least one of the direct positive silver salt emulsion layers according to the invention may be used for various photographic purposes, e.g. as materials with a flat gradation for reprographic purposes, as direct positive X-ray films, for producing direct positive colour images, e.g. by the silver dye bleaching process or the dye diffusion process, or for producing photographic colour images by conventional methods of chromogenic development.

In these direct positive emulsions, the grains may also be provided with a thin protective envelope to improve the fog stability.

The direct positive emulsions may also contain grains with a thin protective envelope for improving the stability of the fog in accordance with published German Patent Application 2,216,075.

The materials according to the invention are also suitable for colour intensifying processes or for producing bubble images in accordance with published German Patent Application 2,201,849.

EXAMPLE

Heterodisperse silver halide emulsions were prepared by running 800 ml of a 3 N silver nitrate solution (inflow time 5 minutes) into 1700 ml of an aqueous solution of 60 g of gelatin and 3 moles of potassium halide in a precipitation apparatus equipped with recirculating pump. The emulsions were ripened physically (temperature 60° C., time 15 minutes) and an additional 200 ml of a 3 N silver nitrate solution was then added in 5 minutes.

The heterodisperse silver halide emulsions differ from each other in the composition of their halides. The following potassium halide solutions were used in the different experiments:

(a) 100 mole % of potassium bromide,
(b) 94 mole % of potassium bromide and 6 mole % of potassium iodide,
(c) 89 mole % of potassium bromide and 11 mole % of potassium iodide,
(d) 85 mole % of potassium bromide and 15 mole % of potassium iodide.

The resulting silver halide emulsions had corresponding halide compositions.

The various samples of emulsions were all prepared in identical conditions. The rate of inflow and time of physical ripening were so adjusted that in all the samples the average particle size was approximately 0.6 μm and at least 10% of the silver halide grains had a particle size, which deviated by at least 40% from this average particle diameter.

After the addition of 90 g of gelatin, the emulsion samples were solidified and then rinsed with water in the usual manner. They were then melted again and chemically ripened to a degree of fogging of 60% in the presence of 12 ml of a $10^{-3}$ molar solution of $Na_3[Au(S_2O_3)_2]$ at a pAg of 6 and pH of 8.5.

Three samples of the emulsions (a) to (d) indicated above were then sensitized in different ways, in each case by the addition of 240 mg of a sensitizer per mole of silver halide. The sensitizing dyes had the following formulae:

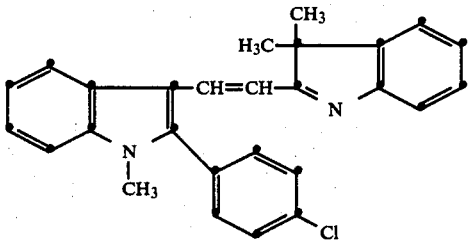

(I)

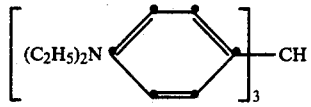

(II)

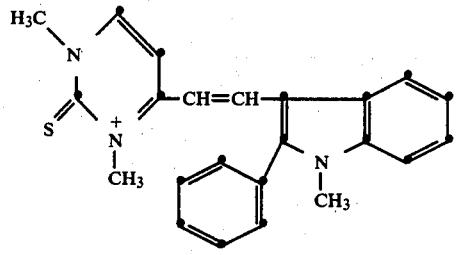

(III)

The emulsion samples were applied to a support of polyethylene terephthalate in the usual manner.

They were exposed in a conventional sensitometer and developed in a developer of the following composition:

1 g of p-methylaminophenol
13 g of sodium sulphite
3 g of hydroquinone
26 g of sodium carbonate
1 g of potassium bromide
made up to 1 liter with water.

The emulsions were then processed in the usual manner.

The results of the sensitometric tests are summarized in the following Table:

TABLE

| Emulsion sample | Mole % of AgI | Sensitivity in rel . log I × t sensitizer I | II | III |
|---|---|---|---|---|
| (a) | 0 | 1.4 | 1.4 | 1.5 |
| (b) | 6 | 1.6 | 1.5 | 1.7 |
| (c) | 11 | 3.8 | 4.6 | 4.0 |
| (c) | 15 | 4.4 | 4.8 | 4.7 |

The above Table shows that the emulsions according to the invention with their high silver iodide content have a substantially higher sensitivity.

We claim:

1. Photographic material comprising at least one layer of a direct-positive radiation-sensitive emulsion containing fogged silver halide grains, wherein the silver halide grains are heterodisperse and irregular and have a grain size distribution so that at least 10% by weight of the silver halide grains have a diameter, which deviates for at least 40% from the mean grain diameter and wherein the silver halide of the grains has a silver iodide content of more than 10 mole % and at most about 20 mole % relative to the total amount of silver halide.

2. Photographic material according to claim 1, wherein at least 20% by weight of the silver halide grains have a diameter, which deviates for at least 40% from the mean grain diameter.

3. A photographic material according to claim 1, wherein the silver iodide content is comprised between about 12 and about 20 mole %.

4. Photographic material according to claim 1, wherein the silver halide grains are free from interior ripening nuclei and have adsorbed to their surface an electron-accepting or desensitizing compound having an anodic polarographic half-wave potential and a cathodic polarographic half-wave potential that when added together give a positive sum.

5. Photographic material according to claim 1, wherein the said silver halide grains have been fogged by reduction sensitisation.

6. Photographic material according to claim 5, wherein the said silver halide grains have been fogged by treatment of the silver halide grains with a reducing agent.

7. Photographic material according to claim 6, wherein said reducing agent is thiourea dioxide or tin-(II) chloride.

8. Photographic material according to claim 5, wherein the silver halide grains have been fogged by low pAg and/or high pH silver halide precipitating or digestion conditions.

9. Photographic material according to claim 5, wherein fogging also occurs in the presence of a compound of a metal more electropositive than silver.

10. Photographic material according to claim 9, wherein said metal compound is a gold compound.

11. Photographic material according to claim 1, wherein the emulsion has been spectrally sensitized.

12. Method of producing direct-positive images, which comprises image-wise exposing and subsequently surface developing a direct-positive material containing fogged silver halide grains wherein the silver halide grains are heterodisperse and irregular and have a grain size distribution so that at least 10% by weight of the silver halide grains have a diameter, which deviates for at least 40% from the mean grain diameter and wherein the silver halide of the grains has a silver iodide content of more than 10 mole % and at most about 20 mole % relative to the total amount of silver halide.

13. Method according to claim 12, wherein development occurs by means of a viscous processing liquid comprising an alkalisoluble polymeric thickening agent.

14. Method according to claim 13, wherein said thicknening agent is carboxymethylcellulose.

* * * * *